US008270861B2

(12) United States Patent
Takahashi et al.

(10) Patent No.: US 8,270,861 B2
(45) Date of Patent: Sep. 18, 2012

(54) IMAGE FORMING APPARATUS AND EXPOSURE CONTROL METHOD OF CONTROLLING EXPOSURE THEREIN

(75) Inventors: Masamitsu Takahashi, Nagoya (JP); Hiroyuki Naganawa, Kasugai (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 168 days.

(21) Appl. No.: 12/843,127

(22) Filed: Jul. 26, 2010

(65) Prior Publication Data

US 2011/0026955 A1 Feb. 3, 2011

(30) Foreign Application Priority Data

Jul. 31, 2009 (JP) ..... 2009-179445

(51) Int. Cl.
*G03G 15/00* (2006.01)
*G03G 15/04* (2006.01)
*G03G 15/16* (2006.01)

(52) U.S. Cl. ..... 399/51; 399/48; 399/66

(58) Field of Classification Search ..... 399/51, 399/66, 46, 48

See application file for complete search history.

(56) References Cited

U.S. PATENT DOCUMENTS 6,404,999 B1 6/2002 Shoji et al.
7,899,349 B2 * 3/2011 Shida ..... 399/66
2002/0168195 A1 * 11/2002 Yokogawa ..... 399/51
2003/0223767 A1 * 12/2003 Park ..... 399/51
2010/0322652 A1 * 12/2010 Torimaru ..... 399/66

FOREIGN PATENT DOCUMENTS

JP 55-089859 A 7/1980
JP 63-169672 A 7/1988
JP 05-045984 2/1993
JP 5-119569 A 5/1993
JP 2001-117380 4/2001
JP 2002-049252 2/2002
JP 2003-015370 A 1/2003
JP 2003-167479 A 6/2003

OTHER PUBLICATIONS

JP Office Action dtd May 10, 2011, JP Appln. 2009-179445, English translation.

* cited by examiner

*Primary Examiner* — Sophia S Chen
(74) *Attorney, Agent, or Firm* — Banner & Witcoff, Ltd.

(57) ABSTRACT

An image forming apparatus including a photosensitive body, a charger configured to charge the photosensitive body, an exposure unit configured to expose the photosensitive body charged by the charger, a developer transport section configured to cause relative movement with respect to the photosensitive body for transporting developer therebetween, a current measurement section configured to measure a current flowing between the photosensitive body and the developer transport section, and a determination unit configured to compare a current with a threshold, the current measured by the current measurement section when the photosensitive body and the developer transport section move relatively to each other and a first area of the photosensitive body that needs to be exposed faces the developer transport section, and determine whether an exposure of the photosensitive body is proper based on a result of the comparison.

20 Claims, 5 Drawing Sheets

IMAGE FORMING APPARATUS AND EXPOSURE CONTROL METHOD OF CONTROLLING EXPOSURE THEREIN

CROSS REFERENCE TO RELATED APPLICATION

The application claims priority from Japanese Patent Application No. 2009-179445 filed on Jul. 31, 2009. The entire content of this priority application is incorporated herein by reference.

TECHNICAL FIELD

The present disclosure relates to an image forming apparatus and to an exposure control method of controlling exposure in the image forming apparatus.

BACKGROUND

An image forming apparatus having a current measurement system for measuring an electrical current in a transfer unit is known. It measures an output current in a condition that the transfer unit is not in operation and that in a different condition. Then, it performs a comparison between the measured output currents. It determines whether the transfer unit is provided, or whether an abnormal operation in switching between standby and contact positions occurs based on the result of the comparison.

In an image forming apparatus, an improper exposure may occur. In this case, a photosensitive body does not get sufficient exposure. However, in the above known image forming apparatus, such an improper exposure is not seriously discussed. It only discloses how to determine whether the transfer unit is provided, or whether an abnormal operation occurs in switching between the standby and contact positions.

SUMMARY

There is a need in the art to provide an image forming apparatus capable of detecting an improper exposure and an exposure control method of controlling the exposure if the improper exposure is detected.

An image forming apparatus according to an aspect of the invention includes a photosensitive body, a charger, an exposure unit, a developer transport section, a current measurement section, and a determination unit. The charger charges the photosensitive body. The exposure unit exposes the charged photosensitive body. The developer transport section causes relative movement with respect to the photosensitive body for transporting developer therebetween. The current measurement section measures a current that flows between the photosensitive body and the developer transport section. It measures a current when the photosensitive body and the developer transport section make relative movements and a first area of the photosensitive body that needs to be exposed faces the developer transport section. The determination means determines whether the exposure is proper based on a comparison of the current measured by the current measurement section with a threshold.

If the photosensitive body is properly exposed, the number of electrons charged on the photosensitive body is sufficiently reduced. As a result, the current measured by the current measurement section when the area (first area) of the photosensitive body faces the developer transport section becomes lower. If the photosensitive body is not properly exposed, that is, an improper exposure occurs, the number of electrons charged on the photosensitive body is not sufficiently reduced. As a result, the current measured by the current measurement section when the area of the photosensitive body faces the developer transport section does not become lower. Namely, the improper exposure can be detected by comparing the measured current with the threshold.

An exposure control method of controlling exposure in the image forming apparatus according to an aspect of the present invention includes charging the photosensitive body by the charger, exposing the charged photosensitive body to light emitted from the exposure unit, measuring a current flowing between the photosensitive body and the developer transport section under a condition that an area (first area) of the photosensitive body that needs to be exposed faces the developer transport section, determining whether the exposure is proper based on a comparison of the current with a threshold, and controlling the exposure unit based on a result of the determination.

BRIEF DESCRIPTION OF THE DRAWINGS

Illustrative aspects in accordance with the present invention will be described in detail with reference to the following drawings wherein.

DETAILED DESCRIPTION

<Illustrative Aspect>

An illustrative aspect of the present invention will be explained with reference to FIGS. 1 through 4.

1. General Construction of Printer

Figure 1:
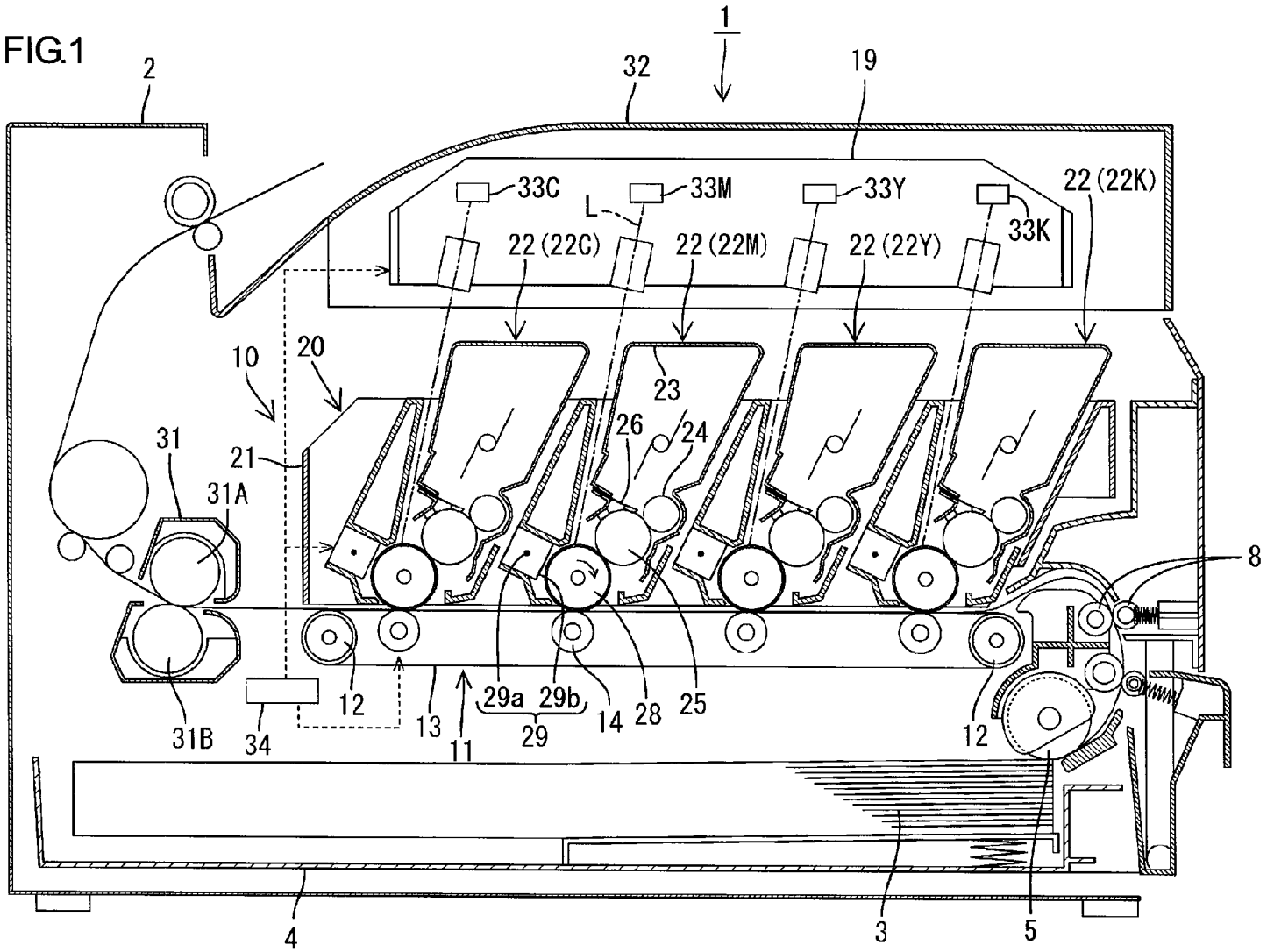
FIG. 1 is a side sectional view illustrating the general construction of a printer according to one of the illustrative aspects of the invention.

FIG. 1 is a side sectional view illustrating the general construction of a color laser printer 1, which is an example of an image forming apparatus of the present invention and hereinafter referred to as the printer.

In the following description, the right side of FIG. 1 corresponds to the front side of the printer 1. Further, printer components provided for respective colors generally have the same structural configuration, and thus the name thereof with a representative number is used in descriptions of those components unless they need to be explained separately. For example, the transfer roller 14 represents the transfer rollers 14K, 14Y, 14M, 14C for colors black, yellow, magenta and cyan, respectively.

The printer 1 includes a main casing 2 and a paper feed tray 4 at the bottom of the main casing 2. Sheets 3 (an example of recording media) are stacked in the paper feed tray 4. A pickup roller 5 is provided above the front end of the paper feed tray 4. A pair of registration rollers 8 is provided above the pickup roller 5. The top sheet 3 in the paper feed tray 4 is picked up by the pickup roller 5 as it rotates and is passed to the registration rollers 8. The registration rollers 8 perform a skew correction for the sheet 3 as necessary and pass the sheet 3 onto a belt unit 11 in an image forming unit 10.

The image forming unit 10 includes the belt unit 11, a scanner unit 19, a process unit 20, a fuser unit 31 and a circuit board 34.

The belt unit 11 is configured such that a belt 13 is stretched and looped over belt rollers 12, one of which is arranged in the front and the other in the rear. The belt 13 rolls counter-clockwise as the rear belt roller 12 revolves and the sheet 3 on the top surface of the belt 13 is passed to the rear.

Inside a loop of the belt 13, the transfer roller 14 is arranged on an opposite side of the belt 13 from a side where a photosensitive drum 28 is arranged in the process unit, which will be explained later. The photosensitive drum 28 is an example of a photosensitive body of the present invention. The transfer roller 14 is an example of a transfer unit that is an object for the current measurement and included in the developer transport section of the present invention. It is prepared by covering a metal roller shaft with a rubber having conductive properties. The transfer roller 14 is pressed against the photosensitive drum 28 so that the sheet 3 is sandwiched between the transfer roller 14 and the photosensitive drum 28 when it is passed through on the belt 13.

The scanner unit 19, which is an example of an exposure unit of the present invention, includes an optical system (not shown). The optical system is configured to apply different colors of laser beams L to the surfaces of the respective photosensitive drums 28. A polygonal mirror (not shown) guides laser beams emitted from laser diodes (LDs) 33 toward the respective photosensitive drums 28.

The process unit 20 includes a frame 21 that can be pulled out of the main casing 2, and four removable developer cartridges 22 (22K, 22Y, 22M and 22C) placed in the frame 21. The developer cartridges 22 are provided for four different colors of developer. In this example, black, yellow, magenta and cyan developer cartridges are arranged in this order from an upstream to the downstream of the sheet feed path. At the bottom of the frame 21, the photosensitive drum 28 and charger 29 are provided for the developer cartridge 22. The charger 29 is an example of a charger of the present invention.

The developing cartridge 22 includes a toner container 23, a feed roller 24, a developing roller 25 and a layer thickness control blade 26. The feed roller 24, the developing roller 25 and the layer thickness control blade 26 are arranged in the lower portion of the developing cartridge 22. The developing roller 25 is an example of a developer transport section that is not an object for the current measurement. The toner container 23 of the developing cartridge 22 contains positive charge toner particles in the corresponding color. The positive charge toner in each color is an example of developer.

The toner particles ejected from the toner container 23 are passed to the developing roller 25 by the feed roller 24 as it revolves, and positively charged due to triboelectricity produced between the feed roller 24 and the respective developing roller 25. The developing roller 25 starts revolving when a developing bias is applied. As the developing roller 25 revolves, the toner particles passed thereon goes through between the layer thickness control blade 26 and the developing roller 25. As a result, the toner particles are more positively triboelectrically charged, and a thin layer of the toner particles with an even thickness is formed on the developing roller 25. The photosensitive drum 28 includes a metal drum body that is grounded and the outer surface thereof is covered with a positive charge photosensitive layer, which may be made of polycarbonate.

The charger 29 is a scorotron charger and includes a discharge wire 29*a* and a grid 29*b*. The discharge wire 29*a* is arranged at a predetermined distance away from the photosensitive drum 28 such that it faces the photosensitive drum 28. The grid 29*b* is arranged between the discharge wire 29*a* and the photosensitive drum 28. It is configured to control the electric discharge from the discharge wire 29*a* to the photosensitive drum 28. In the charger 29, a high voltage is applied to the discharge wire 29*a* to induce corona discharge so that a current from the discharge wire 29*a* to the grid 29*b* remains constant. Namely, the surface of the photosensitive drum 28 is positively charged at an even level by maintaining the grid voltage constant.

The fuser 31 includes a heat roller 31A, which includes a heat source, and a pressure roller 31B, which is configured to press the sheet 3 against the heat roller 31A. It thermally fixes the toner image transferred on the surface of the sheet 3.

2. Image Forming Process

During image formation, the photosensitive drum 28 revolves counter-clockwise and the surface thereof is positively charged at an even potential (e.g., at +800 V) by the charger 29 according to the revolution. A high-speed raster line of the laser beam is emitted from the scanner 19 and the positively charged area of the photosensitive drum is exposed to light of the laser beam. As a result, an electrostatic latent image that corresponds to an image to be printed on the sheet 3 is formed on the surface of the photosensitive drum 28. The exposed area of the surface of the photosensitive drum 28 is charged at +200 V, for example.

The developing roller 25 holds the positively charged toner particles on the surface thereof. As the developing roller 25 revolves, the positively charged toner particles touch the photosensitive drum 28 and cling to the area where the electrostatic latent image is formed. As a result, the electrostatic latent image becomes visible. Because the exposed area on the surface of the photosensitive drum 28 has a potential lower than the developing bias (of about +400 V) that is applied to the developing roller 25, the toner particles are held in the area in a form of a toner image (a developing image)

A negative transfer voltage (of about −3000 V) is applied to the transfer roller 14. The sheet 3 is passed through between the photosensitive drum 28 and the transfer roller 14. When it passes through a transfer point (a transfer nip of the transfer drum 14), the toner image on the surface of the photosensitive drum 28 is transferred onto the sheet 3 due to the negative transfer voltage. The sheet 3 on which the toner image is transferred is passed to the fuser 31 and the toner image is thermally fixed.

The sheet 3 on which the toner image is thermally fixed is transferred from the fuser 31 to an upper area of the printer 1 and ejected onto a paper receiving tray provided on the top surface of the main casing 2.

3. Electrical Configuration of Printer

Figure 2:
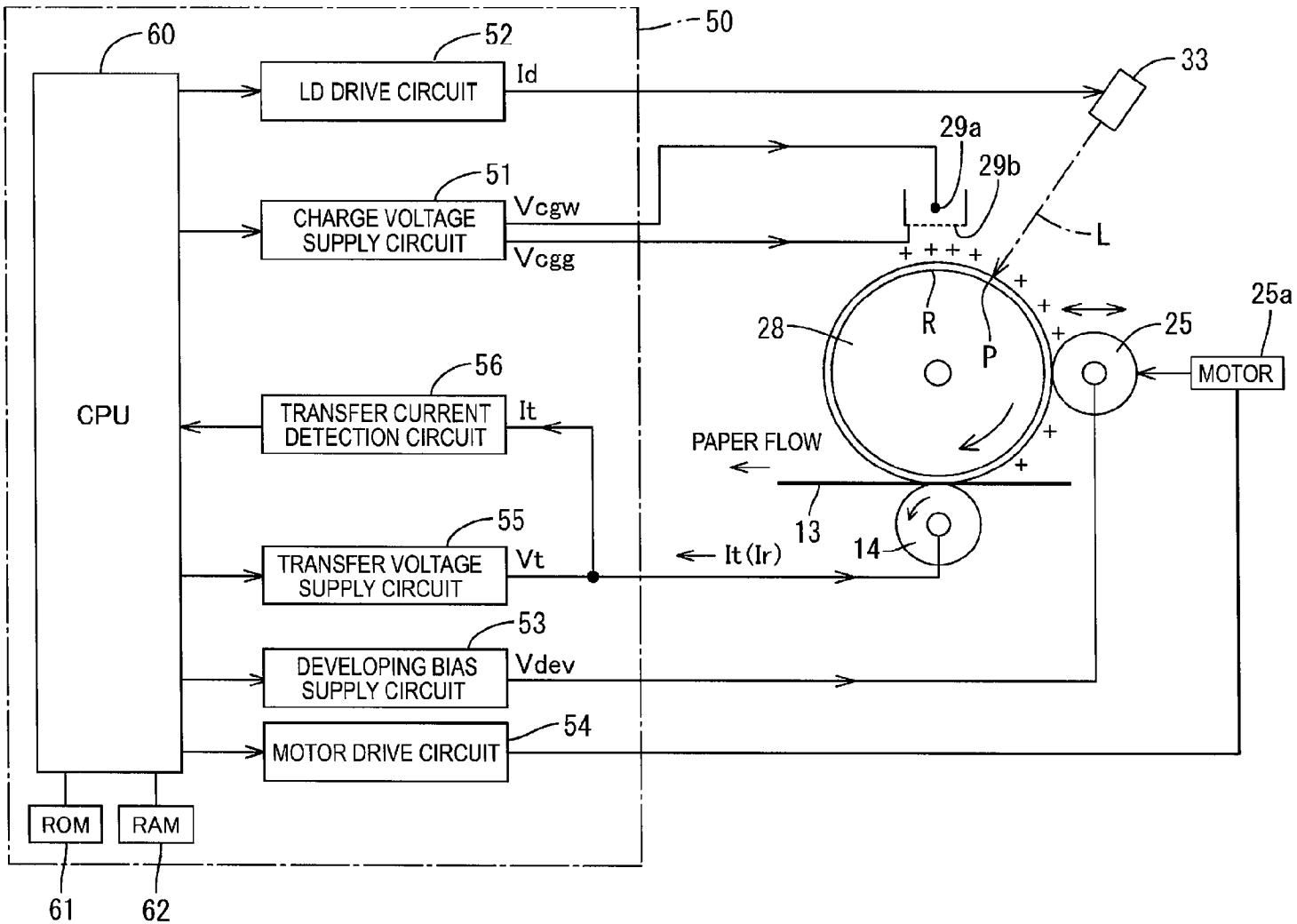
FIG. 2 is a schematic diagram illustrating electrical circuits on a circuit board and printer components relative to the electrical circuits.

FIG. 2 is a schematic diagram illustrating configurations of the electrical circuit 50 formed on the circuit board 34 and the printer components related to the electrical circuit 50. The electrical circuit 50 includes a CPU 60, a ROM 61 and a RAM 62. It further includes a charge voltage supply circuit 51, an LD drive circuit 52, a developing bias supply circuit 53, a motor drive circuit 54, a transfer voltage supply circuit 55 and a transfer current detection circuit 56. The CPU 60 is an example of determination unit, current control section, improper exposure detection execution section, light intensity control section or separation control section. The LD drive circuit 52 is an example of a light intensity control section. The transfer voltage supply circuit 55 is an example of a current control section and a voltage control section. The transfer current detection circuit 56 is an example of current measurement section, current detection circuit, current control section and current control sections.

The ROM 61 stores operation programs. The CPU 60 performs overall control of the printer 1 by executing those operation programs. The RAM 62 stores image data used for the printing process.

The charge voltage supply circuit 51 generates a charge voltage Vcgw that is applied to the discharge wire 29*a* of the charger 29 and a grid voltage Vcgg that is applied to the grid 29*b* of the charger 29.

The LD drive circuit 52 generates an LD drive current Id that is supplied to the LD 33 for illuminating the surfaces of the photosensitive drum 28 with the laser beam L from the LD 33 at a predetermined level (i.e. with a predetermined amount of the laser) according to the control performed by the CPU 60. The developing bias supply circuit 53 generates a developing bias Vdev (the bias voltage) that is applied to the developing roller 25.

The motor drive circuit 54, which is an example of a separation control section, is connected to a motor 25*a* that is provided for bringing the developing roller 25 pressed against or separating it from the photosensitive drum 28. The developing roller 25 is installed so as to be movable in a direction toward the photosensitive drum 28 until it is pressed against the photosensitive drum 28 and in a direction away from the photosensitive drum 28. During the printing operation of the printer 1, the CPU 60 controls the motor drive circuit 54 to drive the motor 25*a* so that the developing roller 25 is pressed against the photosensitive drum 28 to make the toner particles cling to the photosensitive drum 28. In improper exposure detection mode, which will be explained later, the CPU 60 controls the motor drive circuit 54 to drive the motor 25*a* so as to separate the developing roller 25 from the photosensitive drum 28 and restrict a current flowing from the photosensitive drum 28 to the developing roller 25.

The CPU 60 controls the transfer voltage supply circuit 55 to generate a transfer voltage Vt that is applied to the transfer roller 14. The transfer voltage Vt is an example of a bias voltage.

The transfer current detection circuit 56 detects a transfer current It that is generated when the transfer voltage Vt is applied. The CPU 60 performs constant current control to regulate the transfer current It to a predetermined level based on a detection signal (a feedback signal) sent by the transfer current detection circuit 56. When the transfer voltage supply circuit 55 is deactivated, the transfer current detection circuit 56 also detects an inflowing current Ir that flows from the charged photosensitive drum 28 to the transfer current detection circuit 56 via the belt 13 and the transfer roller 14.

4. Timing of Voltage Application and Current Feed

Figure 3:
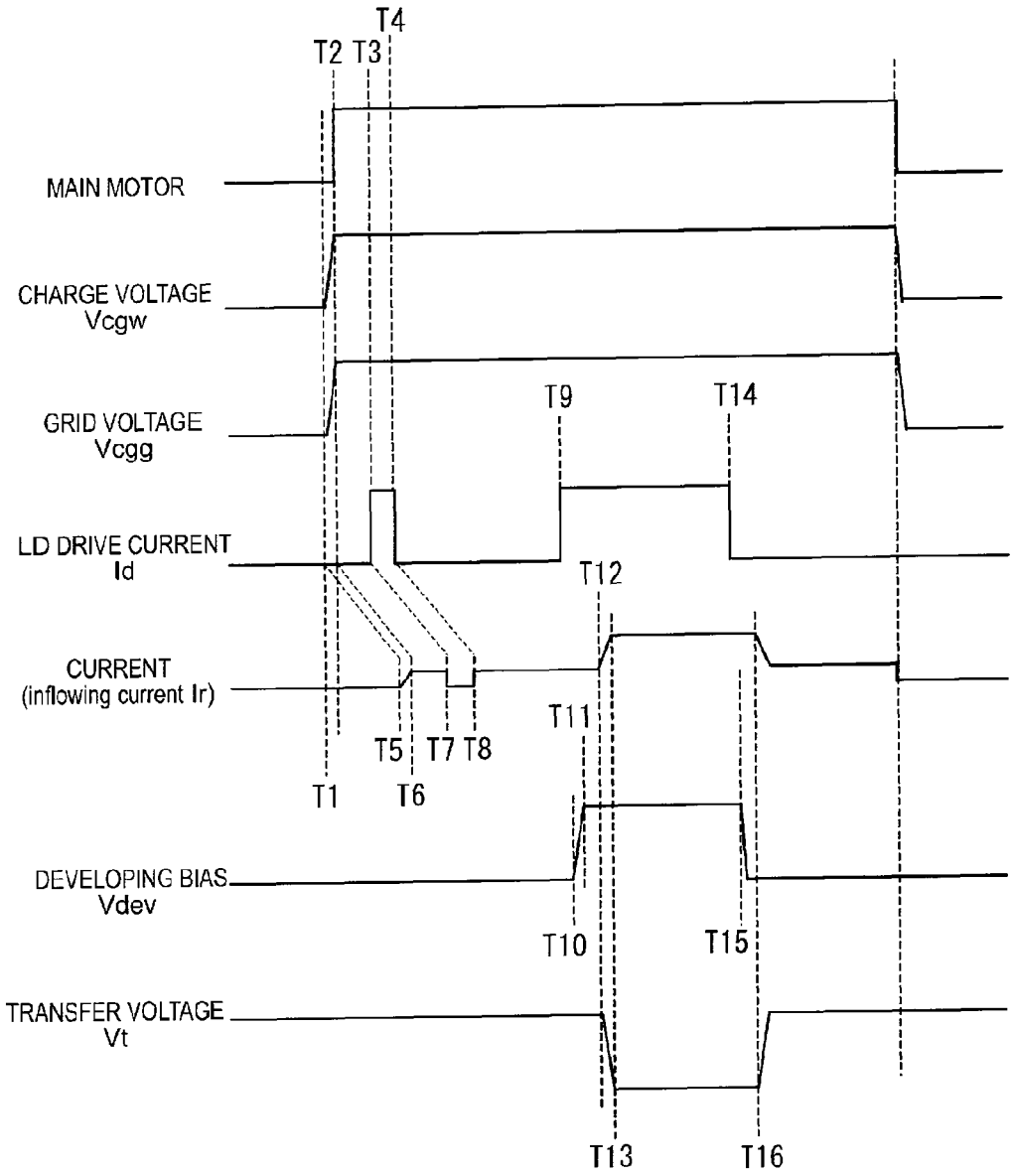
FIG. 3 is a timing chart illustrating variations in voltages and currents according to time.

FIG. 3 is a timing chart that illustrates timing of voltage application and current feed, and also timing of the current flowing from the photosensitive drum to the transfer roller. The voltages and the current explained above vary as in this timing chart. How the LD drive current Id is supplied differs depending on situations in which the exposure is proper or not. The following section describes how the LD drive current Id is supplied when the exposure is proper.

First, the timing of voltage application and current feed will be explained. The CPU 60 controls the charge voltage supply circuit 51 to start application of the charge voltage Vcgw to the discharge wire 29*a* and application of the grid voltage Vcgg to the grid 29*b* at time T1 when a predetermined time has elapsed since the printer 1 is turned on. When the charge voltage Vcgw and the grid voltage Vcgg reach thresholds at T2, the CPU controls the main motor drive circuit (not shown) to rotate the main motor so that the photosensitive drum 28 starts revolving.

At T2, the main motor starts revolving. At T3, the first charged area of the photosensitive drum 28 completely passes through an exposure point P (see FIG. 2) at which the laser beam L from the LD 33 is focused. The CPU 60 remains on standby during the period between T2 and T3. At T3, the CPU 60 controls the LD drive circuit 52 to start supply of the LD drive current Id for the improper exposure detection. Since operations in a condition that the exposure is proper are being discussed here, the LD drive circuit 52 should continuously supply the LD drive current Id to keep the LD 33 turned on. The supply of the LD drive current Id continues until a predetermined time elapses at T4.

At T4, the CPU 60 stops the supply of the LD drive current Id from the LD drive circuit 52 to turn the LD 33 off, and then goes on standby until a print request is input by a user of the printer 1. When the print request is input at T9, the CPU 60 switches the supply of the LD drive current Id between on and off (only the case that the supply remains on is shown in FIG. 3) based on the image data on the image to be printed. Namely, the photosensitive drum 28 is exposed according to the image data and an electrostatic latent image corresponding to the image data is formed on the photosensitive drum 28. The supply of the LD drive current Id continues until a complete shape of the electrostatic latent image is formed at T14.

The exposure of the photosensitive drum 28 starts at T9 and an area of the photosensitive drum 28 that is firstly exposed to the light by the exposure reaches a point where it faces the developing roller 25 shortly after T11. The CPU 60 controls the developing bias supply circuit 53 to start the application of the developing bias Vdev at T10, which is earlier than T11, so that the developing bias Vdev rises to a proper level at the time of T11. The developing bias Vdev is continuously regulated to a constant level until the entire electrostatic latent image on the photoconductive drum 28 becomes visible at T15.

The first exposed area of the photosensitive drum 28 reaches a point where it faces the transfer roller 14 shortly after T13. The CPU 60 controls the transfer bias supply circuit 55 to start the application of the transfer bias Vt at T12, which is earlier than T13, so that the transfer bias Vt rises to a sufficient level at the time of T13. The transfer bias Vt is continuously regulated to a constant level until the entire toner image held by the photosensitive drum 28 is transferred onto the sheet 3 at T16.

Next, the timing at which the inflowing current flows from the photosensitive drum 28 to the transfer roller 14 will be explained. After the charging has started at T1, the first charged area of the photosensitive drum 28 reaches a point where it faces the transfer roller 14 at T5.

When the first charged area of the photosensitive drum 28 has reached the point where it faces the transfer roller 14, the electric charge on the surface of the photosensitive drum 28 moves to the transfer roller 14 via the belt 13, that is, a current flows from the photosensitive drum 28 to the transfer roller 14. The inflowing current Ir rises up to a certain level and then remains at that level.

When the first exposed area of the photosensitive drum 28 has reached at the point where it faces the transfer roller 14 at T7, the inflowing current Ir falls because the electric charge is reduced by the exposure and remains low until the first exposed area passes the point at T8. The exposure is stopped at T4. When an area that has passed the exposure point P after T4 reaches the point where it faces the transfer roller 14, the inflowing current rises back to the previous level and remains at that level.

5. Determination Process in Improper Exposure Detection

An improper exposure is a condition that the photosensitive drum 28 is not properly exposed. Causes of the improper exposure include an improper laser beam level, an improper charge level on the photosensitive drum 28 and broken harnesses. If the LD 33 or the LD drive circuit 52 becomes defective or deteriorates, the proper level of the laser beam cannot be achieved. If the charge voltage supply circuit 51 or the charger 29 becomes defective or deteriorates, the photosensitive drum 28 is not properly charged. Moreover, the photosensitive drum 28 is not properly charged if it itself deteriorates. These causes are only some examples and improper exposure may result from other causes.

When the improper exposure occurs, the photosensitive drum 28 is not properly exposed and the electric charge on the surface thereof is not sufficiently reduced. Therefore, the inflowing current Ir does not fall sufficiently even when the first exposed area of the photosensitive drum 28 reaches the point where it faces the transfer roller 14 at T7 as illustrated in FIG. 3. The CPU 60 detects the improper exposure by comparing a current detected (or measured) in the period between T7 and T8 with a threshold.

Figure 4:
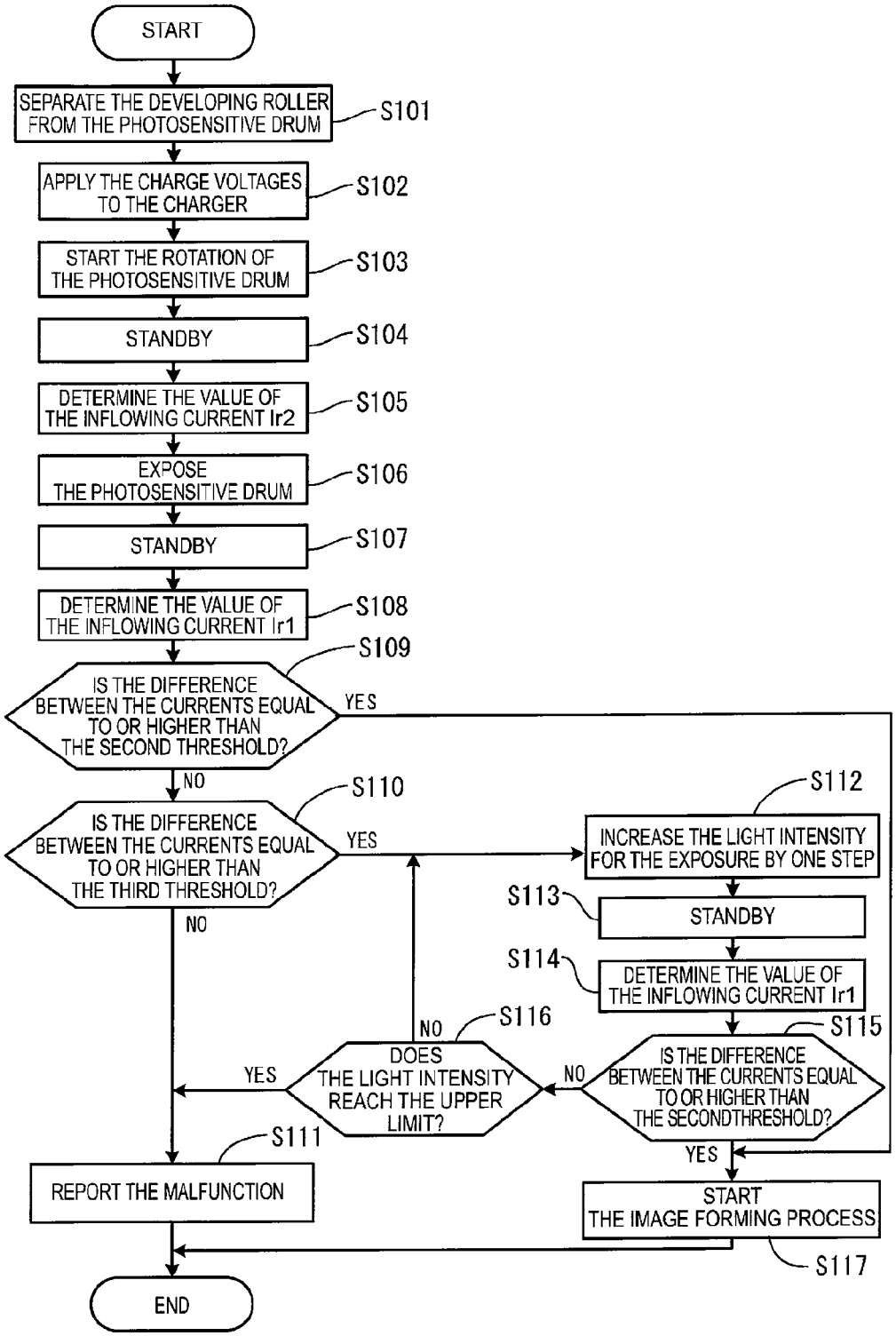
FIG. 4 is a flowchart illustrating an improper exposure detection process.

FIG. 4 is a flowchart of the determination process in the improper exposure detection. When the printer 1 is turned on, the CPU 60 enters improper exposure detection mode before starting the image forming process. The determination process starts when the CPU 60 enters improper exposure detection mode.

In step S101, the CPU 60 drives the motor 25*a* to separate the developing roller 25 from the photosensitive drum 28 so that a current does not flow between the photosensitive drum 28 and the developing roller 25.

In step S102, the CPU 60 controls the charge voltage supply circuit 51 to apply the charge voltages (the charge voltage Vcgw, the grid voltage Vcgg) to the charger 29 (at T1 in FIG. 3). As a result, the charging of the photosensitive drum 28 starts.

In step S103, the CPU 60 drives the maim motor to start the rotation of the photosensitive drum 28 (at T2).

In step S104, the CPU 60 remains on standby until the first charged area of the photosensitive drum 28 reaches the point where it faces the transfer roller 14. The CPU 60 starts a timer (not shown) at T1 at which the application of the charge voltages to the charger 29 starts. When a predetermined time (a period between T1 and T5) has elapsed, the CPU 60 assumes that the first charged area of the photosensitive drum 28 reaches the point where it faces the transfer roller 14. To determine other points of timing, it also uses the timer to determine elapsed time and determine the timing based on the elapsed time.

In step S105, the inflowing current Ir starts flowing from the charged area of the photosensitive drum 28 to the transfer roller 14 via the belt 13 when the first charged area of the photosensitive drum 28 reaches the point where it faces the transfer roller 14 (at T5). The inflowing current Ir rises to a constant level at T6. The CPU 60 controls the transfer current detection circuit 56 and determines the value of the inflowing current Ir during the period between T6 and T7. Namely, the CPU 60 measures the second flowing current Ir2 that flows into the transfer roller 14 when the second area of the photosensitive drum 28 faces the transfer roller 14, where the second area is an area that is not exposed on the surface of the photosensitive drum 28. The second inflowing current Ir2 is an example of a current measured by the current measurement unit when-the second area of the photosensitive body, which is an unexposed area of the photosensitive body, faces the developer transport section.

In step S106, the CPU 60 controls the LD drive circuit 52 so that the photosensitive drum 28 is exposed (between T3 and T4). If the exposure step of S106 is performed prior to step S105, a step in which the value of the inflowing current Ir1 from the first area of the photosensitive drum 28 is determined (step S108, which will be explained later) can be performed immediately after step S105 and before step S106. The first area of the photosensitive drum 28 is an area that needs to be exposed on the surface of the photosensitive drum 28.

In step S107, the CPU 60 remains on standby until the photosensitive drum 28 rotates and the area thereof needs to be exposed reaches the point where it faces the transfer roller 14. "The area thereof needs to be exposed (first area)" refers to an area that is actually exposed by the exposure unit when the exposure is proper. The reason why the area is expressed as "the area needs to be exposed" instead of "the exposed area" is that it may not be exposed at all when improper exposure occurs. Namely, "the area needs to be exposed" is a target area of the exposure performed by the exposure unit whether the improper exposure occurs.

In step S108, the inflowing current Ir1 flows from the first area of the photosensitive drum 28 to the transfer roller 14 via the belt 13 when the first area reaches the point where it faces the transfer roller 14 (at T7). The CPU 60 controls the transfer current detection circuit 56 and determines the value of the inflowing current Ir during the period between T7 and T8. Namely, the CPU 60 measures the first inflowing current Ir1 flowing into the transfer roller 14 when the first area of the photosensitive drum 28 faces the transfer roller 14. The first inflowing current Ir1 is an example of a current measured by the current measurement section when the area of the photosensitive body, which is an area of the photosensitive body that needs to be exposed, faces the developer transport section.

In step S109, the CPU 60 calculates a difference between the first and the second inflowing currents measured in step S105 and step S108, respectively, compare the difference with the second threshold, and determines whether the exposure is proper based on the result of the comparison. By comparing the difference with the second threshold, chances of false detection of the improper exposure due to environmental factors, such as ambient temperature and humidity, during the measurement can be reduced. If the exposure is proper, the difference should be substantially the same because the environmental factors affect the value of the currents flowing from the first area and the first area at the same level. Namely, by comparing the difference between the first inflowing current and the first inflowing current with the threshold, the improper exposure is properly detected without affected by the environmental factors.

If the difference is lower than the second threshold, the CPU 60 determines that the exposure is improper and proceeds to step S110. If the difference is equal to or higher than the second threshold, the CPU 60 determines that the exposure is proper and proceeds to step S117.

In step S110, the CPU 60 compares the difference with the third threshold that is lower than the second threshold. If the difference is lower than the third threshold, the CPU 60 determines that a printer component that affects the exposure of the photosensitive drum 28 is defective, that is, the printer component does not function at all or its performance is reduced due to deterioration.

The printer component that affects the exposure of the photosensitive drum 28 is such as the LD drive circuit 52, the LD 33, the charge voltage supply circuit 51, the charger 29 and the harnesses. If the LD 33 becomes defective, for example, the first area of the photosensitive drum 28 is not properly exposed. As a result, the electrical charge is not reduced as much as it should be by the exposure and the difference between the first and the second inflowing currents (i.e., the currents flowing from the area that should be exposed and from the area should not be exposed) is equal to or close to zero.

If the charger 29 becomes defective, it cannot charge the photosensitive drum 28 to a proper level. As a result, the first inflowing current Ir1 does not vary largely from the second inflowing current Ir2 and thus the difference between them is equal to or close to zero.

If the photosensitive drum 28 becomes defective (or deteriorated in this case), it cannot be properly charged. As a result, the electrical charge is not reduced as much as it should be by the exposure and the difference in the first and the first inflowing currents Ir is equal to or close to zero.

By comparing the difference with the third threshold, the malfunctions of the printer components can be detected. When a printer component other than the ones that described above becomes defective, the malfunction may affect the exposure of the photosensitive drum 28. If the improper exposure occurs due to the malfunction, the difference in the currents also becomes equal to or close to zero and thus the malfunction can be detected. When the malfunction is detected, the CPU 60 proceeds to step S111. If the malfunction is not detected, the CPU 60 proceeds to step S112.

In step S111, the CPU 60 reports the malfunction, for example, by displaying a message indicating the malfunction on a display screen of the printer 1, by providing audio information, or by sending email to an administrator of the printer 1.

In step S112, the CPU 60 controls the LD drive circuit 52 to increase the amount of laser light emitted from the LD 33 by one step and to expose the photosensitive drum 28 to the increased intensity of light. Although the amount of increase per step can be set to any amount, it should be set to a small amount because the total amount of the light may largely exceed a proper level if the amount of increase per step is set to a large amount.

In step S113, the CPU 60 remains on standby until the photosensitive drum 28 revolves and the area thereof that needs to be exposed in step S112 reaches the point that it faces the transfer roller 14. When the area reaches the point where it faces the transfer roller 14 in step S114, a signal that indicates the first inflowing current Ir1 is output from the transfer current detection circuit 56 and it is input to the CPU 60.

In step S115, the CPU 60 determines whether the exposure is proper in the same manner as step S109. If the exposure is improper, the CPU 60 proceeds to step S116. If the exposure is proper, the CPU 60 proceeds to step S117.

In step S116, the CPU 60 determines whether the number of times that the intensity of light emitted from the LD 33 is increased exceeds the limit, or whether the light intensity reaches the upper limit. If at least one of results of the determinations is yes, the CPU 60 determines that a malfunction occurs, and proceeds to step S111. If both of them are no, the CPU 60 returns to step S112 and repeat the steps.

In step S117, the CPU 60 starts the image forming process.

6. Effect of Illustrative Aspect

The printer 1 of this illustrative aspect can detect the improper exposure of the photosensitive drum 28 based on the comparison of the first inflowing current with the threshold.

Further, the inflowing current Ir is measured for the improper exposure detection while the constant current control, which regulates the transfer voltage Vt applied to the transfer roller 14 to a constant level, is deactivated. If the constant current control is activated, the current is quickly returned to the original level even when the inflowing current Ir is present. Therefore, the inflowing current Ir is not measured precisely. By measuring the inflowing current Ir while the constant current control is deactivated, variations in the current continue for a certain period of time. Thus, the inflowing current Ir is more easily measured (or detected).

The transfer current detection circuit 56 is used for measurement of the inflowing current Ir. The transfer current detection circuit 56 is included in the current control section (CPU 60, transfer voltage supply circuit 55 and transfer current detection circuit 56) for the constant current control that regulates the transfer voltage Vt to the constant level. Namely, extra printer components are not required for the measurement of the inflowing current Ir and thus the number of parts of the printer 1 does not increase.

The difference between the first and the first inflowing currents is compared with the second threshold. Therefore, the improper exposure is reliably detected regardless of the environmental factors in the inflowing current measurement.

If the difference is lower than the third threshold, which is lower than the second threshold, a malfunction of the exposure unit is determined, that is, the exposure unit is not practically functioning.

If the improper exposure is detected, the LD 33 is controlled so as to increase the intensity of light emitted from the LD 33. Therefore, an impact of the improper exposure can be reduced.

If the improper exposure is detected, the intensity of light emitted from the LD 33 is increased such that the difference between the first and the second inflowing currents is equal to or higher than the second threshold. If the difference is equal to or higher than the second threshold, the exposure is considered as proper. Therefore, an impact of the improper exposure can be reduced by increasing the intensity of light so that the difference is equal to or higher than the second threshold.

<Another Illustrative Aspect>

Figure 5:
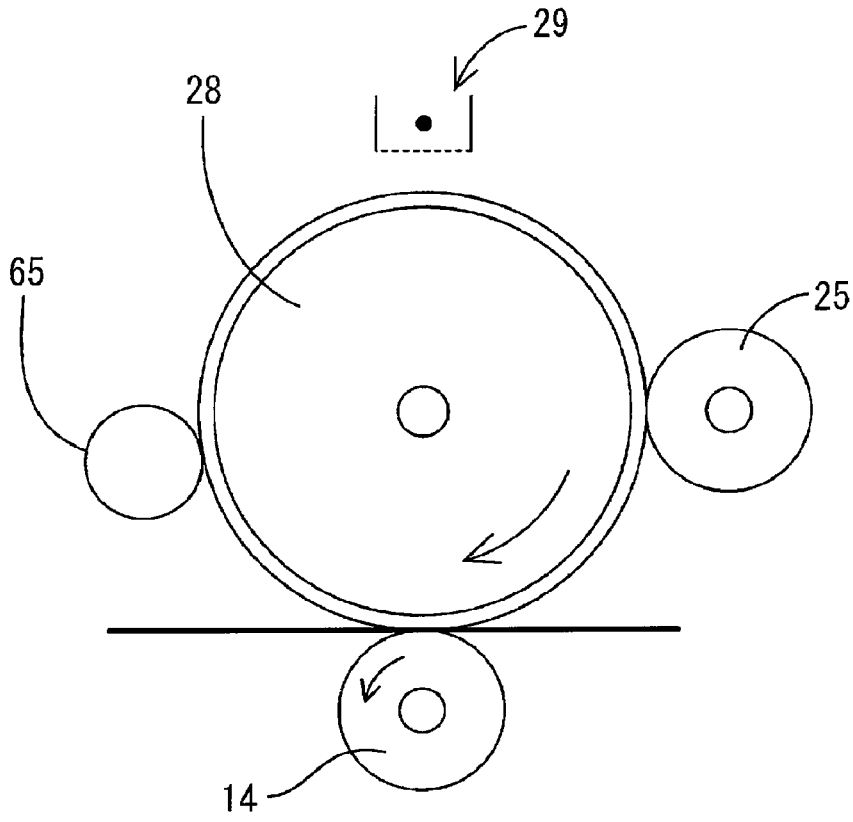
FIG. 5 is a schematic diagram illustrating a developer transport section according to the illustrative aspect of the invention.

Next, another illustrative aspect of the present invention will be explained with reference to FIG. 5.

In this aspect, a cleaning section is added to the printer 1 of the illustrative aspect described above and other configurations are the same. The same printer components as those in the previous illustrative aspect are indicated by the same symbols and will not be explained.

The cleaning section includes cleaning rollers 65 and a cleaning voltage supply circuit (not shown). Each cleaning roller 65 is arranged in a location ahead of the corresponding transfer roller 14 and behind the corresponding charger 29 in the rotation direction of the photosensitive drum 28. It is pressed against the transfer roller 14 by a pressing member (not shown). The cleaning voltage supply circuit is configured to apply a bias voltage to the cleaning roller 65. After the transfer of an image onto the sheet 3 by the transfer roller 14 is complete, the bias voltages are applied to the cleaning roller 65, and residues, such as paper and toner residues, on the photosensitive drum 28 are collected temporarily by the cleaning roller 65.

The developing roller 25 is an example of the transfer unit that is not an object for the current measurement. The cleaning roller 65 is also an example of the transfer unit that is not an object for the current measurement. The transfer roller 14 is an example of the transfer unit that is an object for the current measurement.

When the CPU 60 measures the inflowing current Ir for the improper exposure based on a signal from the transfer current detection circuit 56, the developing roller 25 is separated from the photosensitive drum 28 while keeping the cleaning roller 65 pressed against the photosensitive drum 28. Because the cleaning roller 65 does not face the first area of the photosensitive drum 28 before the first area reaches the point where it faces the transfer roller 14, it does not affect the accuracy of the inflowing current measurement. By keeping the cleaning roller 65 pressed against the developing roller 25, a separation control mechanism for separating a transfer unit that is not an object for the current measurement from the photosensitive drum 28 can be simplified.

<Other Illustrative Aspects>

The present invention is not limited to the aspect explained in the above description made with reference to the drawings. The following aspects may be included in the technical scope of the present invention, for example.

(1) In the above aspect, the improper exposure is detected based on the inflowing current Ir flowing from the photosensitive drum 28 to the transfer roller 14. However, it may be detected based on an inflowing current flowing from the photosensitive drum 28 to the developing roller 25, that is, to a transfer unit that is an object for the inflowing current measurement. It may be also detected based on an inflowing current flowing from the photosensitive drum 28 to the cleaning roller 65. In this case, the developing roller 25 and the transfer roller 14 are separated from the photosensitive drum 28 to restrict current flow between the photosensitive drum 28 and the feed parts that are not objects for the measurement, that is, the developing roller 25 and the transfer roller 14. Thus, the value of the inflowing current can be accurately measured.

(2) In the above aspect, when the improper exposure is detected, the intensity of light emitted from the LD 33 is increased. However, the developing bias Vdev (the bias voltage) applied to the developing roller 25 may be varied instead of or in addition to the increase in the intensity of light emitted from the LD 33 so as to increase the amount of developer transported to the photosensitive drum 28.

(3) In the above aspect, the difference between the first and the second inflowing currents is compared with the second threshold and whether the exposure is proper is determined based on the result of the comparison. However, it may be determined based on a result of comparison between the first inflowing current and the first threshold. In this case, the exposure is determined as improper if the first inflowing current is equal to or higher than the first threshold. If the exposure is determined as improper, the intensity of light is increased to maintain the inflowing current lower than the first threshold.

(4) In the above aspect, the current flowing from the area of the photosensitive drum 28 that is not exposed (i.e., the second flowing current) is measured first and then the current flowing from the area of the photosensitive drum 28 that needs to be exposed (i.e., the first flowing current) is measured. However, the first flowing current may be measured first and then the second flowing current may be measured. In this case, the first area of the photosensitive drum 28 returns to a point where the LD 33 charges the photosensitive drum 28 (point R in FIG. 2) faster in comparison to the case that current flowing from the second area is measured first. Therefore, exposed points on the photosensitive drum 28, where electrical potential is lower than unexposed points on the photosensitive drum 28, can be recovered faster and thus a start of the image forming process is not interfered.

(5) In the above aspect, the printer 1 enters improper exposure detection mode when it is turned on. However, it may be configure to enter improper exposure detection mode at a certain interval under the condition that the image forming process is not performed. Alternatively, it may be configured to enter improper exposure detection mode upon a request input from the outside.

(6) In the above aspect, a color laser printer is used as an example of an image forming apparatus. However, an image forming apparatus of the present invention is not limited to a color laser printer, but rather may be a monochrome laser printer, a color LED printer or a monochrome LED printer. Further, it may be a multi-function machine having a facsimile function, a copier function, and the like.

What is claimed is:

1. An image forming apparatus comprising:

a photosensitive body;

a charger configured to charge the photosensitive body;

an exposure unit configured to expose the photosensitive body charged by the charger;

a developer transport section configured to cause relative movement with respect to the photosensitive body for transporting developer therebetween according to an application of a bias voltage;

a processor;

a memory having machine readable instructions that, when executed by the processor, cause the image forming apparatus to perform steps including:

measuring a current flowing between the photosensitive body and the developer transport section while the application of the bias voltage is disabled;

comparing a current with a threshold, the current being measured in the measuring step when the photosensitive body and the developer transport section move relatively to each other and a first area of the photosensitive body that needs to be exposed faces the developer transport section; and determining whether an exposure of the photosensitive body is proper based on the step of comparing.

2. The image forming apparatus according to claim 1, wherein the developer transport section includes a transfer unit configured to transfer the developer image from the photosensitive body to a recording medium, and wherein the instructions, when executed by the processor, further cause the image forming apparatus to perform a step of regulating a transfer current supplied to the transfer unit to a constant level based on a current flowing from the photosensitive body to the transfer unit and detected by a current detection circuit, wherein the instructions, when executed by the processor, cause the current detection circuit to perform the step of measuring.

3. The image forming apparatus according to claim 1, wherein the step of comparing compares a current with a first threshold, the current being measured in the measuring step when the first area of the photosensitive body faces the developer transport section, and the step of determining determines that exposure of the photosensitive body is improper when the current is equal to or higher than the first threshold.

4. The image forming apparatus according to claim 3, wherein the instructions, when executed by the processor, further cause the image forming apparatus to perform the step of controlling an intensity of light emitted from the exposure unit and to increase the intensity of light so as to decrease the current measured in the measuring step below the first threshold when an improper exposure of the photosensitive body is determined in the step of determining.

5. The image forming apparatus according to claim 1, wherein the step of comparing includes determining a difference between a current measured in the measuring step when a second area of the photosensitive body that is not exposed faces the developer transport section and a current measured in the measuring step when the first area of the photosensitive body faces the developer transport section, and wherein the step of determining determines that the exposure of the photosensitive body is improper when the difference is lower than a second threshold.

6. The image forming apparatus according to claim 5, wherein the instructions, when executed by the processor, further cause the image forming apparatus to perform the step of controlling an intensity of light emitted from the exposure unit and to increase the intensity of light so as to increase the difference equal to or higher than the second threshold when an improper exposure of the photosensitive body is determined by the step of determining.

7. The image forming apparatus according to claim 5, wherein the instructions, when executed by the processor, further cause the image forming apparatus to perform the step of starting an improper exposure detection mode prior to image formation and to perform the step of measuring the current flowing from the photosensitive body when the first area of the photosensitive body faces the developer transport section first and to perform the step of measuring the current flowing from the photosensitive body when the second area of the photosensitive body faces the developer transport section.

8. The image forming apparatus according to claim 5, wherein the step of comparing includes determining that a malfunction occurs when the difference is lower than a third threshold that is lower than the second threshold.

9. The image forming apparatus according to claim 1, further comprising a voltage control circuit, wherein:

the developer transport section is configured to transport the developer according to an application of a bias voltage; and the voltage control circuit controls the bias voltage applied to the developer transport section so as to increase an amount of the developer transported to the photosensitive body by the developer transport section when the step of determining determines that the exposure is improper.

10. The image forming apparatus according to claim 1, wherein the developer transport section includes a plurality of developer transport sections; and wherein the instructions, when executed by the processor, further cause the image forming apparatus to perform the step of separating at least one of the plurality of developer transport sections that is not an object for the current measurement from the photosensitive body when the step of measuring measures the current.

11. The image forming apparatus according to claim 10, wherein the step of separating separates one of the developer transport sections that is not an object for the measurement and faces the first area of the photosensitive body before the first area of the photosensitive body reaches a point where the first area of the photosensitive body faces the developer transport section that is an object for the current measurement.

12. An exposure control method of controlling exposure in an image forming apparatus including a photosensitive body, a charger, an exposure unit, and a developer transport section, the method comprising steps of:

charging the photosensitive body by the charger;

exposing the charged photosensitive body to light emitted from the exposure unit;

measuring a current flowing between the photosensitive body and the developer transport section under a condition that a first area of the photosensitive body that needs to be exposed faces the developer transport section while an application of a bias voltage to the developer transport section is disabled;

determining whether the exposure is proper based on a comparison of the current with a threshold; and controlling the exposure unit based on a result of the determination.

13. The exposure control method according to claim 12, wherein the developer transport section includes a transfer unit configured to transfer the developer image from the photosensitive body to a recording medium, the method further comprising controlling a transfer current supplied to the transfer unit at a constant level based on the measured current flowing from the photosensitive body to the transfer unit.

14. The exposure control method according to claim 12, wherein the step of determining determines that the exposure is improper when the current is equal to or higher than the threshold, the method further comprising the step of increasing an intensity of light emitted from the exposure unit so as to decrease the current below the threshold when the determining step determines that the exposure is improper.

15. The exposure control method according to claim 12, wherein:

the step of measuring includes measuring a first current and a second current flowing from the photosensitive body to the developer transport section under a condition that the first area of the photosensitive body faces the developer transport section and under a condition that a second area of the photosensitive body that is not exposed faces the developer transport section, respectively; and the step of determining includes comparing a difference between the first current and the second current with a second threshold, and determining that the exposure is improper when the difference is lower than the second threshold.

16. The exposure control method according to claim 15, further comprising the step of:

increasing an intensity of light emitted from the exposure unit so as to increase the difference equal to or above the second threshold when the step of determining determines that the exposure is improper.

17. The exposure control method according to claim 12, further comprising, controlling a bias voltage applied to the developer transport section so as to increase an amount of the developer for transporting between the photosensitive body and the developer transport section.

18. The exposure control method according to claim 12, wherein the developer transport section includes a plurality of developer transport sections, the method further comprising the step of:

separating one of the developer transport sections that is not an object for the measurement and faces the first area of the photosensitive body before the first area of the photosensitive body reaches a point where the first area of the photosensitive body faces the developer transport section that is an object for the current measurement.

19. An image forming apparatus comprising:

a photosensitive body;

a charger configured to charge the photosensitive body;

an exposure unit configured to expose the photosensitive body charged by the charger;

a developer transport section configured to cause relative movement with respect to the photosensitive body for transporting developer therebetween;

a processor;

a memory having machine readable instructions that, when executed by the processor, cause the image forming apparatus to perform steps including:

measuring a current flowing between the photosensitive body and the developer transport section;

comparing a current with a threshold, the current being measured in the measuring step when the photosensitive body and the developer transport section move relatively to each other and a first area of the photosensitive body that needs to be exposed faces the developer transport section; and determining whether an exposure of the photosensitive body is proper based on the step of comparing, wherein the step of comparing includes determining a difference between a current measured in the measuring step when a second area of the photosensitive body that is not exposed faces the developer transport section and a current measured in the measuring step when the first area of the photosensitive body faces the developer transport section, and wherein the step of determining determines that the exposure of the photosensitive body is improper when the difference is lower than a second threshold.

20. An exposure control method of controlling exposure in an image forming apparatus including a photosensitive body, a charger, an exposure unit, and a developer transport section, the method comprising steps of:

charging the photosensitive body by the charger;

exposing the charged photosensitive body to light emitted from the exposure unit;

measuring a current flowing between the photosensitive body and the developer transport section under a condition that a first area of the photosensitive body that needs to be exposed faces the developer transport section determining whether the exposure is proper based on a comparison of the current with a threshold; and controlling the exposure unit based on a result of the determination, wherein the step of measuring includes measuring a first current and a second current flowing from the photosensitive body to the developer transport section under a condition that the first area of the photosensitive body faces the developer transport section and under a condition that a second area of the photosensitive body that is not exposed faces the developer transport section, respectively, and wherein the step of determining includes comparing a difference between the first current and the second current with a second threshold, and determining that the exposure is improper when the difference is lower than the second threshold.

* * * * *